US011747746B2

(12) United States Patent
Kawashima

(10) Patent No.: US 11,747,746 B2
(45) Date of Patent: Sep. 5, 2023

(54) IMAGE FORMING APPARATUS

(71) Applicant: CANON KABUSHIKI KAISHA, Tokyo (JP)

(72) Inventor: Tomomichi Kawashima, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/698,363

(22) Filed: Mar. 18, 2022

(65) Prior Publication Data

US 2022/0317588 A1 Oct. 6, 2022

(30) Foreign Application Priority Data

Mar. 31, 2021 (JP) ..... 2021-059415

(51) Int. Cl.
*G03G 15/04* (2006.01)
*G03G 21/08* (2006.01)
*G03G 21/16* (2006.01)

(52) U.S. Cl.
CPC ..... *G03G 15/04036* (2013.01); *G03G 21/08* (2013.01); *G03G 21/1633* (2013.01)

(58) Field of Classification Search
CPC ..... G03G 21/08; G03G 15/04036; G03G 21/1633
See application file for complete search history.

(56) References Cited

U.S. PATENT DOCUMENTS 5,565,961 A * 10/1996 Shoji ..... G03G 21/1853 399/111
8,064,799 B2 11/2011 Tanaka
10,379,458 B2 8/2019 Ishihara
2002/0172530 A1* 11/2002 Kido ..... G03G 21/08 399/128
2006/0060751 A1* 3/2006 Nishimura ..... G03G 21/08 250/216

(Continued)

FOREIGN PATENT DOCUMENTS

JP 2010020123 A 1/2010
JP 2011064711 A 3/2011

(Continued)

OTHER PUBLICATIONS

Machine Translation of JP 2018-169466. (Year: 2018).*

*Primary Examiner* — Carla J Therrien
(74) *Attorney, Agent, or Firm* — ROSSI, KIMMS & McDOWELL LLP

(57) ABSTRACT

In an image forming apparatus having a housing; a cartridge including an image bearing member and capable of being attached/detached to/from the housing; a discharging exposure unit having a light source member and a light guide member, which forms a light guide path guiding light from the light source member so as to be emitted to the image bearing member, and exposing the image bearing member; and an opening/closing member capable of being opened/closed and provided on a surface on which an opening portion, through which the cartridge is inserted/removed in the housing, is provided so as to cover the opening portion, wherein the light source member is provided so as to be exposed to a surface of the housing opened/closed by the opening/closing member and be capable of being attached/detached to/from the light guide member.

14 Claims, 10 Drawing Sheets

(56) References Cited

U.S. PATENT DOCUMENTS

| | | | | |
|---|---|---|---|---|
| 2006/0198645 | A1* | 9/2006 | Yamada | G03G 15/0862 399/148 |
| 2010/0080623 | A1* | 4/2010 | Tanaka | G03G 21/1666 399/118 |
| 2013/0308977 | A1* | 11/2013 | Fujii | G03G 21/1671 399/128 |
| 2015/0277360 | A1* | 10/2015 | Abe | G03G 21/1671 399/128 |
| 2016/0062261 | A1* | 3/2016 | Oi | G03G 21/08 399/128 |
| 2016/0282752 | A1* | 9/2016 | Oi | G03G 21/08 |
| 2018/0321611 | A1* | 11/2018 | Ishihara | G03G 15/1615 |
| 2021/0263465 | A1* | 8/2021 | Katsumata | G03G 21/1671 |

FOREIGN PATENT DOCUMENTS

| | | | |
|---|---|---|---|
| JP | 2018169466 | A | 11/2018 |
| JP | 2018189793 | A | 11/2018 |

* cited by examiner

IMAGE FORMING APPARATUS

BACKGROUND OF THE INVENTION

Field of the Invention

The present invention relates to an electrophotographic image forming apparatus such as a copier, a printer and the like.

Description of the Related Art

In an electrophotographic image forming apparatus or particularly a medium-to-high-speed apparatus of which printing speed is relatively fast, an image defect called a drum ghost is caused by a difference in charged potential on a photosensitive drum surface as an image bearing member. Thus, a configuration to prevent occurrence of the image defect is known in which a discharging exposure unit which discharges a remaining potential by emitting light to the photosensitive drum surface before charging is provided. The static discharging by the discharging exposure unit is performed at timing after transfer and before the charging in an electrophotographic process of charging, exposing, developing, and transferring performed on the photosensitive drum.

As a light source for the discharging exposure unit, an LED is mainly used, and when the LED reaches a service life, and a light amount thereof is lowered, there is a concern that this would lead to the image defect such as a drum ghost and thus, a replacement work is performed by a service staff as necessary. That is, when the discharging exposure unit irradiates the photosensitive drum surface in order to prevent the above-described drum ghost, it is necessary to irradiate an entire region in an axis direction of the photosensitive drum with a light amount not smaller than a lower limit value determined in advance. On the other hand, if the light amount to be emitted is large, light fatigue of the photosensitive drum would easily progress and thus, an upper limit value at which the discharging exposure unit irradiates the photosensitive drum is also determined, and the discharging exposure unit irradiates the photosensitive drum while satisfying the set upper limit value and lower limit value. In the discharging exposure unit as above, a configuration is used in which light guiding unit to irradiate the photosensitive drum with light from the LED, which is a light source, is provided (Japanese Patent Application Publication No. 2018-189793). Moreover, as another configuration, a configuration is also known in which the photosensitive drum is irradiated directly with light from an LED substrate on which a plurality of LEDs are arranged without interposing or disposing the light guiding unit such as a light guide (Japanese Patent Application Publication No. 2018-169466).

SUMMARY OF THE INVENTION

In the aforementioned conventional arts, at the end of service life or in case of a failure of the LED relative to the discharging exposure unit, attachment/detachment or a replacement work is rapidly needed. However, with size reduction of the image forming apparatus, an interval between each of constituent components has become extremely small. Since the discharging exposure unit is close to transfer unit and a transfer belt, there has been a problem in that the replacement work of the discharging exposure unit is difficult to be performed at maintenance. Particularly, in a work in which a hand is inserted into an image forming apparatus main body, since visibility is poor, and a work space is small, the replacement work is extremely difficult.

An object of the present invention is to provide, in an image forming apparatus including exposure unit for static elimination, an image forming apparatus which improves replacement workability of light source components.

The image forming apparatus according to the present invention to solve the aforementioned problem comprises:

a housing;

a cartridge including an image bearing member and capable of being attached/detached to/from the housing;

a discharging exposure unit having a light source member and a light guide member, which forms a light guide path for guiding light from the light source member so as to be emitted to the image bearing member, and exposing the image bearing member; and an opening/closing member capable of being opened/closed and provided on a surface on which an opening portion, through which the cartridge in the housing is inserted/removed, is provided so as to cover the opening portion, wherein the light source member is provided so as to be exposed to the surface of the housing opened/closed by the opening/closing member and be capable of being attached/detached to/from the light guide member.

According to the present invention, in the image forming apparatus including the exposure unit for static discharging, the replacement workability of the light source components can be improved.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

In this embodiment, a case of an application to a color laser-beam printer which employs a quadruple-drum type and a process-cartridge type, capable of forming a full-color image by using an electrophotographic system will be described. Here, the process-cartridge type is configured such that a developing unit as a process unit which executes an image forming process and an electrophotographic image bearing member (photosensitive drum) are integrated as a process cartridge, and this process cartridge is configured attachable/detachable to/from an image forming apparatus main body. In the following explanation, the apparatus main body refers to a constituent part excluding a detachable configuration such as the process cartridge and the like in the configuration of the image forming apparatus.

(1) Outline Configuration of Image Forming Apparatus

Figure 1:
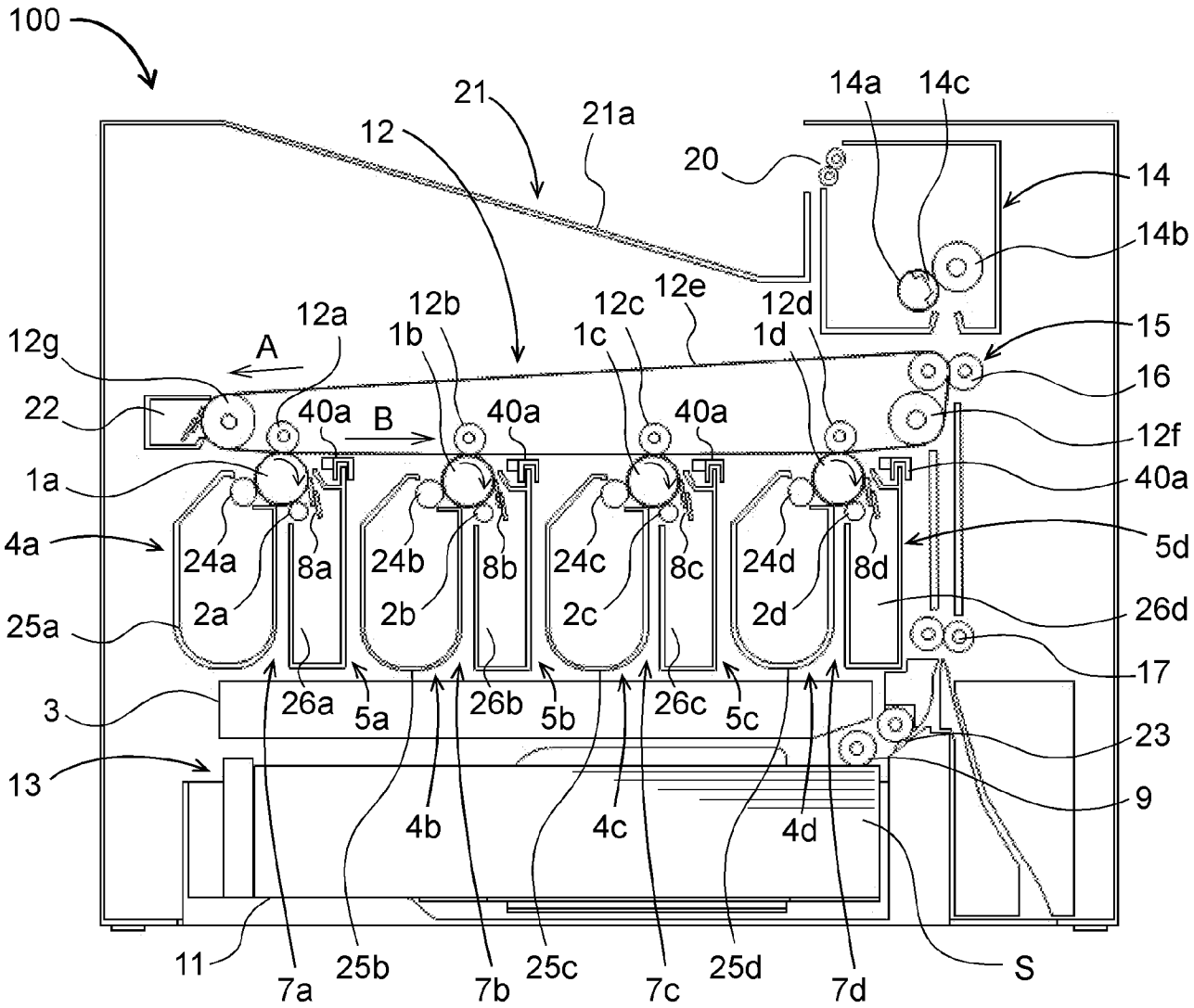
FIG. 1 is a schematic cross-sectional view of an image forming apparatus according to an embodiment.

Hereinafter, a first embodiment of the present invention will be described on the basis of figures. FIG. 1 is a sectional view illustrating an outline configuration of an image forming apparatus 100 main body when the image forming apparatus 100 is seen from a front surface side in an embodiment of the present invention. As shown in FIG. 1, this image forming apparatus is a tandem-type color image forming apparatus in which four process cartridges 7*a*, 7*b*, 7*c*, and 7*d* are aligned on a straight line.

(1-1) Forming Process of Toner Image

Formation of a toner image is performed by a photosensitive drum 1, a charging unit 2, an exposure unit 3, a developing unit 4 having a developing roller. The image forming apparatus 100 includes four rotatable photosensitive drums 1*a*, 1*b*, 1*c*, and 1*d*. In a periphery of each of the photosensitive drums 1, the charging units 2 (2*a*, 2*b*, 2*c*, 2*d*) which uniformly charges a surface of the photosensitive drum 1 in order following a rotating direction thereof and the exposure unit 3 which forms a static latent image on the photosensitive drum 1 by emitting a laser on the basis of image information are disposed. Subsequently, developing rollers 24 (24*a*, 24*b*, 24*c*, 24*d*) as the developing unit which forms an image as a toner image by causing a toner to adhere to a static latent image, transfer units 12*a*, 12*b*, 12*c*, 12*d* which transfer the toner image on the photosensitive drum 1 to an intermediate transfer belt 12*e* are disposed. And cleaning units 8 (8*a*, 8*b*, 8*c*, 8*d*) which removes a transfer residual toner remaining on the surface of the photosensitive drum 1 after the transfer is disposed adjacent to the charging unit 2.

The photosensitive drum 1 (1*a*, 1*b*, 1*c*, 1*d*), the charging unit 2 (2*a*, 2*b*, 2*c*, 2*d*), the developing unit 4 (4*a*, 4*b*, 4*c*, 4*d*), and the cleaning unit 5 (5*a*, 5*b*, 5*c*, 5*d*) are integrated and form the process cartridge 7 (7*a*, 7*b*, 7*c*, 7*d*). These four process cartridges 7*a*, 7*b*, 7*c*, 7*d* have the same structure but are different in a point that images in different colors are formed by toners in yellow (Y), magenta (M), cyan (C), and black (Bk).

Figure 2:
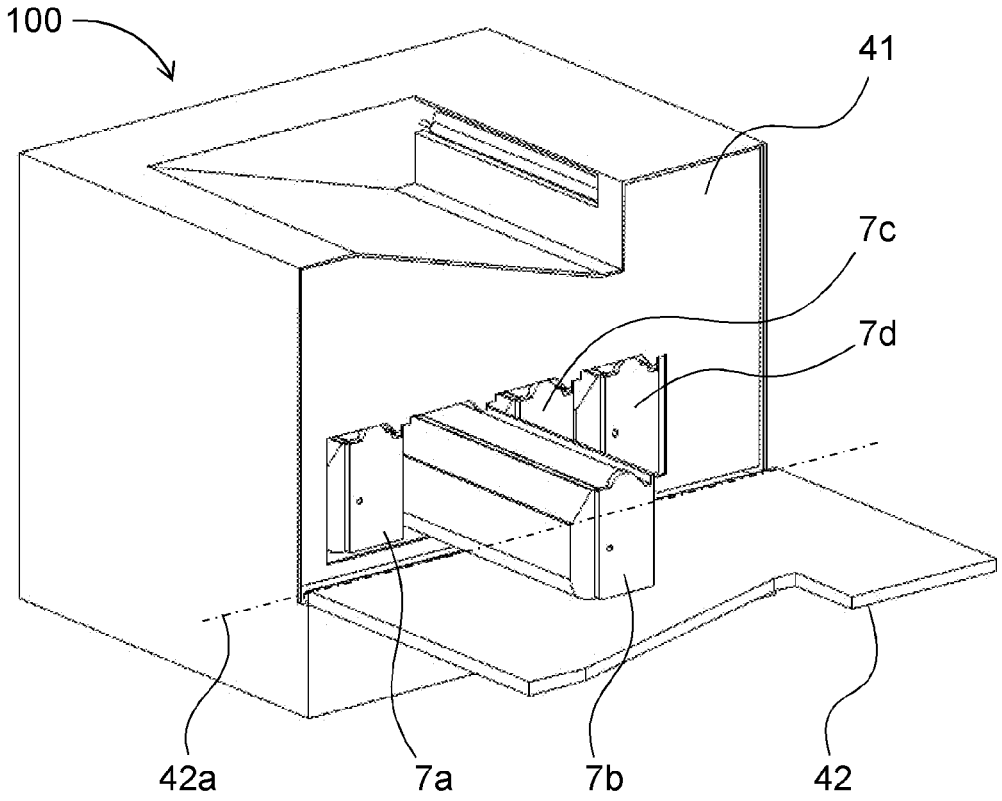
FIG. 2 is a perspective view illustrating a state at attachment/detachment of a process cartridge of the image forming apparatus.

FIG. 2 is a perspective view illustrating a state at attachment/detachment of the process cartridge 7 of the image forming apparatus 100. The process cartridges 7*a*, 7*b*, 7*c*, 7*d* are provided capable of being attached/detached inside a housing 40 of the image forming apparatus 100, respectively, and in this embodiment, it is configured such that they can be attached/detached by opening an opening/closing cover 42 from a front surface side of the image forming apparatus 100. Moreover, a protective cover 41 which protects the discharging exposure unit which will be described later is further attached to the image forming apparatus 100.

In this embodiment, a configuration and an operation of each image forming portion have many common parts. Therefore, in the following description, when discrimination is not particularly required, suffixes a, b, c, d given to signs in order to indicate that they are elements provided for any one of the colors are omitted and described generally.

Subsequently, each of constituent components constituting the process cartridge 7 will be described. The photosensitive drum 1 is constituted by applying an organic photo conductor layer (OPC) on an outer peripheral surface of a cylinder made of aluminum, and both end portions thereof are rotatably supported by a bearing or the like. When a driving force is transmitted from a drive motor (not shown) to one of end portions of the photosensitive drum 1, it is rotated/driven in a clockwise direction indicated by an arrow in FIG. 1.

The charging unit 2 is a conductive roller formed having a roller shape, and the photosensitive drum 1 surface is uniformly charged by bringing this roller into contact with the photosensitive drum 1 surface and applying a charging voltage by a power source (not shown). The exposure unit 3 is disposed vertically below the process cartridge 7 and performs exposure to the photosensitive drum 1 on the basis of an image signal.

The developing unit 4 includes a toner container 25 and a developing roller 24. The toner containers 25*a*, 25*b*, 25*c*, 25*d* contain toners in each of the colors Y, M, C, and Bk, respectively. The developing rollers 24*a*, 24*b*, 24*c*, 24*d* are disposed adjacent to the photosensitive drums 1*a*, 1*b*, 1*c*, 1*d* surfaces and transit to a contact state or a separated state with respect to the corresponding photosensitive drums 1*a*, 1*b*, 1*c*, 1*d*, respectively. In the contact state, the developing roller 24 is rotated/driven by a drive portion (not shown), and by applying the voltage, it develops the toner on the surfaces of the photosensitive drums 1*a*, 1*b*, 1*c*, 1*d*.

With the configuration as above, the toner images in Y, M, C, Bk are formed on the photosensitive drums 1*a*, 1*b*, 1*c*, 1*d* surfaces. The toner images formed on the photosensitive drums 1*a*, 1*b*, 1*c*, 1*d* surfaces are primarily transferred to the intermediate transfer belt 12*e* surface sequentially (primary transfer process). After that, the toner remaining on the photosensitive drum 1 is removed by the cleaning unit 8 of the cleaning unit 5 and is recovered by a transfer residual toner container 26.

(1-2) Transfer Process to Sheet Material, Fixing Process

Transfer of the toner image to a sheet material S is performed in a secondary transfer portion 15 after the sheet material S is transported to the secondary transfer portion 15 by a paper feed device 13. The intermediate transfer unit 12 carries the toner image formed by the primary transfer process and transports the toner image to the secondary transfer portion 15. A fixing device 14 is located on a downstream side in a sheet material S transport direction of the secondary transfer portion 15 and fixes the toner image transferred onto the sheet material S.

First, configurations of the paper feed device 13, the intermediate transfer unit 12, and the fixing device 14 will be described. The paper feed device 13 is constituted by a paper feed cassette 11 accommodating mainly the sheet material S, a paper feed roller 9, a separating unit 23, and a resist roller pair 17 which sandwiches and transports the sheet material S. The paper feed cassette 11 can be pulled out of the image forming apparatus 100. A user pulls the paper feed cassette 11 out of the image forming apparatus 100 and then, sets the sheet material S on the paper feed cassette 11 and attaches it to the image forming apparatus 100, whereby the sheet material S can be supplied.

The intermediate transfer unit 12 is constituted mainly by the intermediate transfer belt (intermediate transfer material) 12*e*, a driver roller 12*f*, a driven roller 12*g*, primary transfer rollers 12*a*, 12*b*, 12*c*, 12*d* which are primary transfer units, and a cleaning device 22. The intermediate transfer belt 12*e* is an endless cylindrical belt and is extended between the driver roller 12*f* and the driven roller 12*g*. The driven roller 12*g* is biased by a biasing unit (not shown) to an A direction indicated by an arrow in FIG. 1 and applies a predetermined tension to the intermediate transfer belt 12*e*. By rotation/driving of the driver roller 12*f* by a motor (not shown) or the like, the intermediate transfer belt 12*e* is rotated at a predetermined speed in a B direction indicated by the arrow in FIG. 1. Each of the primary transfer rollers 12*a*, 12*b*, 12*c*, 12*d* is disposed on an inner side of the intermediate transfer belt 12*e* by opposing each of the photosensitive drums 1*a*, 1*b*, 1*c*, 1*d*. By applying the voltage to the primary transfer rollers 12*a* 12*b*, 12*c*, 12*d*, the toner image formed on each of the photosensitive drums 1*a*, 1*b*, 1*c*, 1*d* surfaces is primarily transferred onto the intermediate transfer belt 12*e*.

The fixing device 14 is constituted mainly by a fixing film 14*a*, a pressure roller 14*b*, a heating body 14*c*, and a paper-ejection roller pair 20. The fixing film 14*a* is an endless cylindrical belt, and an outer peripheral surface of the fixing film 14*a* is disposed on a toner-image surface side on the sheet material S. The heating body 14*c* is disposed on an inner side of the fixing film 14*a*, and the pressure roller 14*b* is in pressure contact via the fixing film 14*a*. The pressure roller 14*b* is rotated/driven by a driving unit (not shown), the fixing film 14*a* is rotated with that, and the fixing film 14*a* is heated by the heating body 14*c*.

In a transport direction of the sheet material S, the paper-ejection roller pair 20 and a paper-ejection tray 21 are disposed on a downstream side of the fixing film 14*a*. The paper-ejection tray 21 has an inclined surface 21*a* inclined with respect to a horizontal direction. The inclined surface 21*a* is inclined to a direction in which the paper-ejection roller pair 20 side is lowered.

Subsequently, operations of the paper feed device 13, the intermediate transfer unit 12, and the fixing device 14 will be described. The paper feed roller 9 is in pressure contact with the sheet material S accommodated in the paper feed cassette 11 and sends out the sheet material S by being rotated at predetermined control timing, and the sheet material S is separated by the separating unit 23 to one each and fed. After that, the sheet material S is transported by the resist roller pair 17 to the secondary transfer portion 15. Moreover, the toner images in four colors are transferred and carried in an overlapped manner on the intermediate transfer belt 12*e* and transported to the secondary transfer portion 15. In the secondary transfer portion 15, a bias voltage is applied to a secondary transfer unit 16, whereby the toner image on the intermediate transfer belt 12*e* is transferred onto the transported sheet material S. After the secondary transfer, the toner remaining on the intermediate transfer belt 12*e* is removed by the cleaning device 22 and is transported to a toner collecting container (not shown) disposed in the image forming apparatus 100. The sheet material S transported from the secondary transfer portion 15 is sandwiched/transported by the fixing film 14*a* and the pressure roller 14*b*, and the toner image is heated/fixed onto the sheet material S. The sheet material S on which the toner image is fixed is then, sandwiched/transported by the paper-ejection roller pair 20 and is ejected to the paper-ejection tray 21. Even in a state where a plurality of the sheet materials S are stacked on the paper-ejection tray 21, the subsequent sheet material S is ejected. Since the stacked sheet materials S are also inclined by following the inclined surface 21*a* provided in the paper-ejection tray 21, the ejected sheet material S does not push out the stacked sheet material S but is stacked on the paper-ejection tray 21 in an aligned state.

Regarding the image forming apparatus described above, description is made with a color laser printer such as a tandem type or the like which transfers color toners in two colors or more on a recording material via the intermediate transfer belt and forms an image as a typical example. However, application of the present invention is not limited to that but can be made to a monochromatic laser printer using a monochromatic toner in a single color.

(2) Configuration of Static-Eliminating Exposure Means

Figure 3:
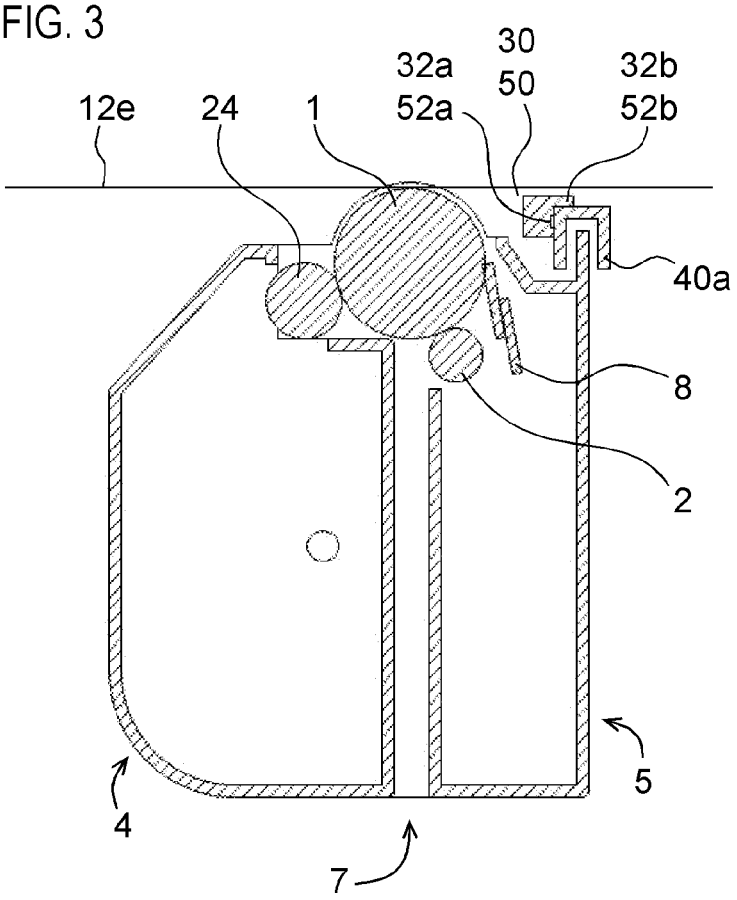
FIG. 3 is a schematic cross-sectional view illustrating the process cartridge and a discharging exposure unit.

FIG. 3 is a cross sectional view illustrating an outline configuration of the discharging exposure unit 30 and constituent members in the vicinity thereof in an embodiment of the present invention. In this embodiment, the discharging exposure unit 30 is provided not in the process cartridge 7 but on a stay 40*a* forming a part of the housing 40 which is a main-body frame of the image forming apparatus 100 and is disposed close to the intermediate transfer belt 12*e* in the vicinity of the photosensitive drum 1. In the periphery of the photosensitive drum 1, the charging unit 2, an exposure portion by the exposure unit 3, the developing roller 24, a primary transfer portion by the primary transfer rollers 12*a* to 12*d*, the discharging exposure unit 30, and the cleaning unit 8 are disposed in order from an upstream of an image forming process. The discharging exposure unit 30 is disposed on the downstream side of the primary transfer portion and on the upstream side of the cleaning unit 8 in the image forming process. That is, the discharging exposure unit 30 is disposed with an appropriate clearance from each of constituent elements in a region surrounded by the photosensitive drum 1 to be electrostatically discharged, the cleaning unit 5, the intermediate transfer belt 12*e*, and the developing unit 4 of the adjacent process cartridge 7.

Figure 4:
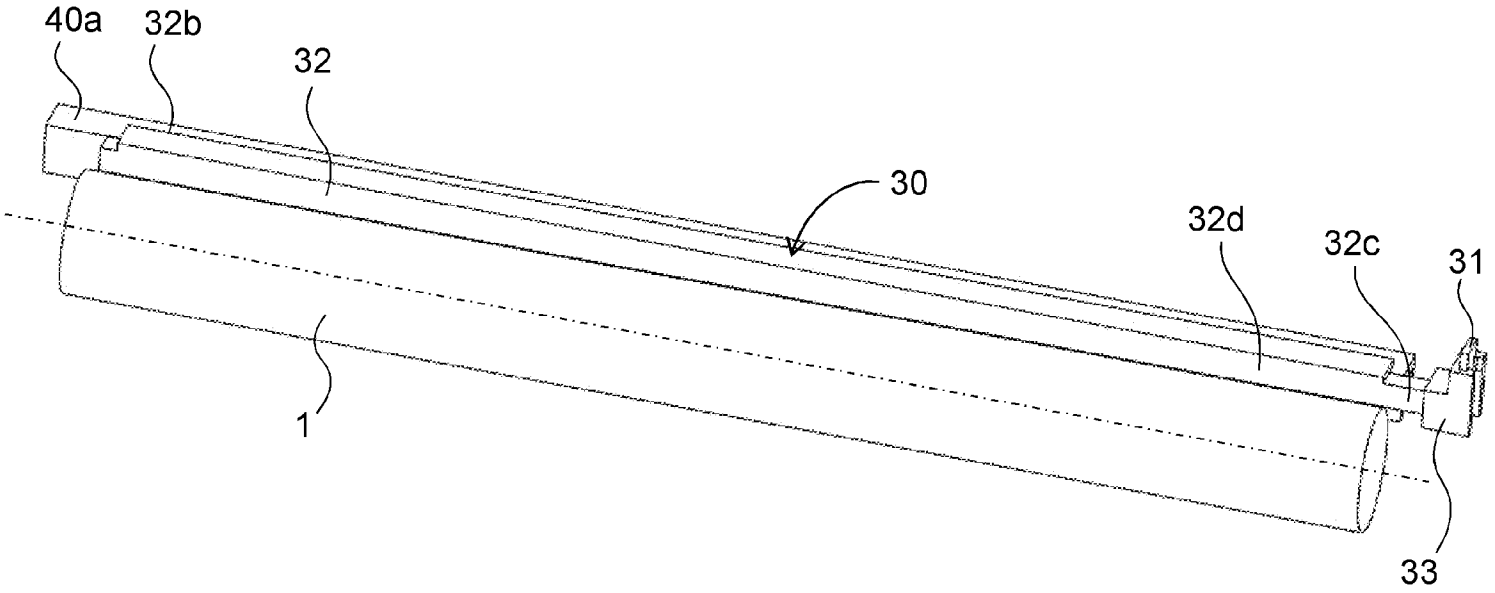
FIG. 4 is a perspective view illustrating the discharging exposure unit according to a first embodiment.
Figure 5:
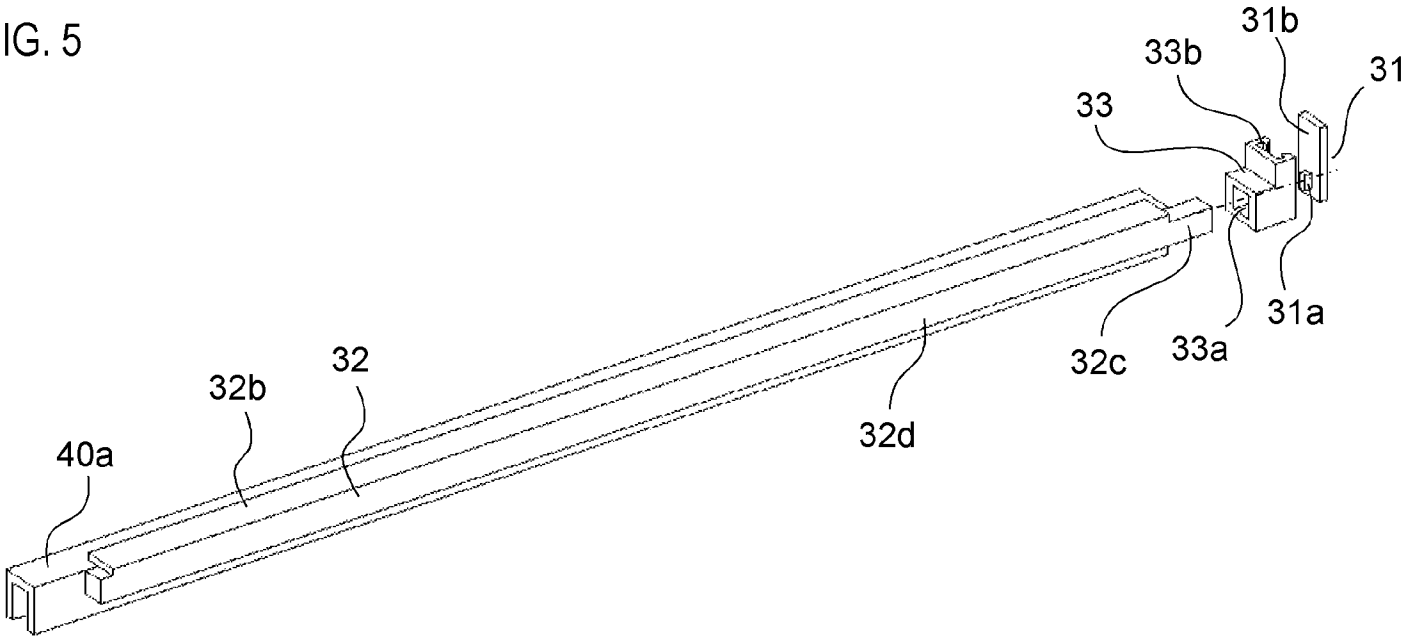
FIG. 5 is a perspective view illustrating a component configuration of the discharging exposure unit according to the first embodiment.

The configuration of the discharging exposure unit 30 will be described. FIG. 4 is a perspective view illustrating an outline configuration of the discharging exposure unit 30, and FIG. 5 is a perspective view illustrating a state where the constituent components of the discharging exposure unit 30 are separated. The discharging exposure unit 30 is constituted by an LED substrate 31 as a light source member, a light guide 32 as a light guide member, and a positioning member 33 interposed therebetween and linking them. In the LED substrate 31, an LED 31*a* as a light source which emits light is mounted on a substrate portion 31*b*. Moreover, the light guide 32 is an elongated member along a rotation axis of the photosensitive drum 1, and a light guide path which guides the light so that the light incident from the LED 31*a* is emitted to the photosensitive drum 1 is formed. The light guide 32 needs to receive incidence and to emit light and thus, it is formed of a transparent resin in this embodiment. The light guide path of the light guide 32 is constituted by a first light guide path 32*c* and a second light guide path 32*d* extending in the axis direction of the photosensitive drum 1. The first light guide path 32*c* is faced with the LED 31*a*, and when the light from the LED 31*a* is incident to the first light guide path 32*c*, the light is guided from the first light guide path 32*c* to the second light guide path 32*d*, and the second light guide path 32*d* emits the light to an entire region in the longitudinal direction of the photosensitive drum 1. Moreover, in this embodiment, the first light guide path 32*c* extends from the second light guide path 32*d* along the rotation axis of the photosensitive drum 1 similarly to the second light guide path 32*d*.

The positioning member 33 includes a through hole 33*a* which guides the light from the LED 31*a* to the light guide 32 and a substrate holding portion 33*b* engaged with the substrate portion 31*b*. In this embodiment, the LED substrate 31 is constituted to be engaged with the positioning member 33 so that a surface having the LED 31*a* is perpendicular to the through hole 33*a*. The substrate holding portion 33*b* has an elastically deformable snap-fit structure and holds the LED substrate 31 by being engaged with the substrate portion 31*b*. The substrate holding portion 33*b* which is an elastically deforming portion is constituted by having a cantilever structure which extends in the same direction as a direction in which the through hole 33*a* extends. By pressing the LED substrate 31 into the positioning member 33, the substrate holding portion 33*b* is elastically deformed to a non-regulated position, and when the LED substrate 31 is fit in at a predetermined position, the substrate portion 31*b* is held by returning to a regulated position.

Figure 6B:
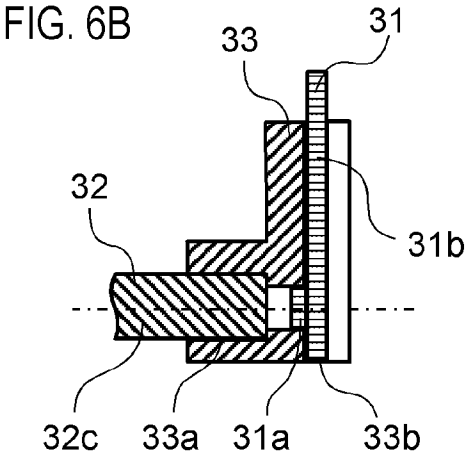
FIGS. 6A and 6B are detailed cross-sectional views illustrating a component configuration of the discharging exposure unit according to the first embodiment.
Figure 6A:
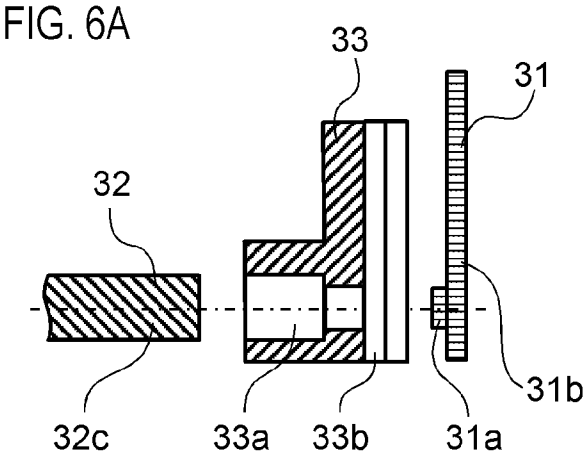

FIGS. 6A and 6B are detailed cross-sectional views illustrating a component configuration of the discharging exposure unit on a cross section at an axis center of the through hole 33*a*. FIG. 6A illustrates a state before the constituent components are assembled, while FIG. 6B illustrates a state after the assembling. In this embodiment, the through hole 33*a* of the positioning member 33 is constituted such that two square holes having cross sections with different sizes communicate with each other and has a step between the two square holes. When the positioning member 33 is engaged with the light guide 32, the first light guide path 32*c* is engaged with the hole with the larger cross section of the through hole 33*a*, and when it is pushed in by a certain amount or more, it is brought into contact with the step and is positioned without being pushed in anymore. Moreover, the positioning member 33 and the LED substrate 31 are disposed so that the LED 31*a* is fitted in the hole with the smaller cross section when they are engaged by the substrate holding portion 33*b* and the substrate portion 31*b*, and the light of the LED 31*a* is delivered to the light guide 32 through the through hole 33*a*. Note that, in this embodiment, the through hole 33*a* is a square hole in compliance with the shape of the LED 31*a* or the first light guide path 32*c*, but when their shapes are changed, the shape of the through hole 33*a* can be changed accordingly.

With the configuration as above, the LED 31*a* and the light guide 32 linked by the positioning member 33 are held in a positioned state and are disposed such that the light emitted from the LED 31*a* is incident to the light guide 32 without a loss. The light of the LED 31*a* is different from a laser beam and has a directive characteristic spread with a predetermined scanning angle with a light emitting source as a start point. Thus, in order to irradiate the photosensitive drum 1 appropriately, the LED 31*a* and the light guide 32 need to be controlled to be at predetermined positions. Moreover, as shown in FIG. 3, a reflection surface 32*a* and a protection portion 32*b* covering it are provided on the light guide 32, and the light incident to the light guide 32 and reflected by the reflection surface 32*a* is emitted to the photosensitive drum 1.

Figure 7:
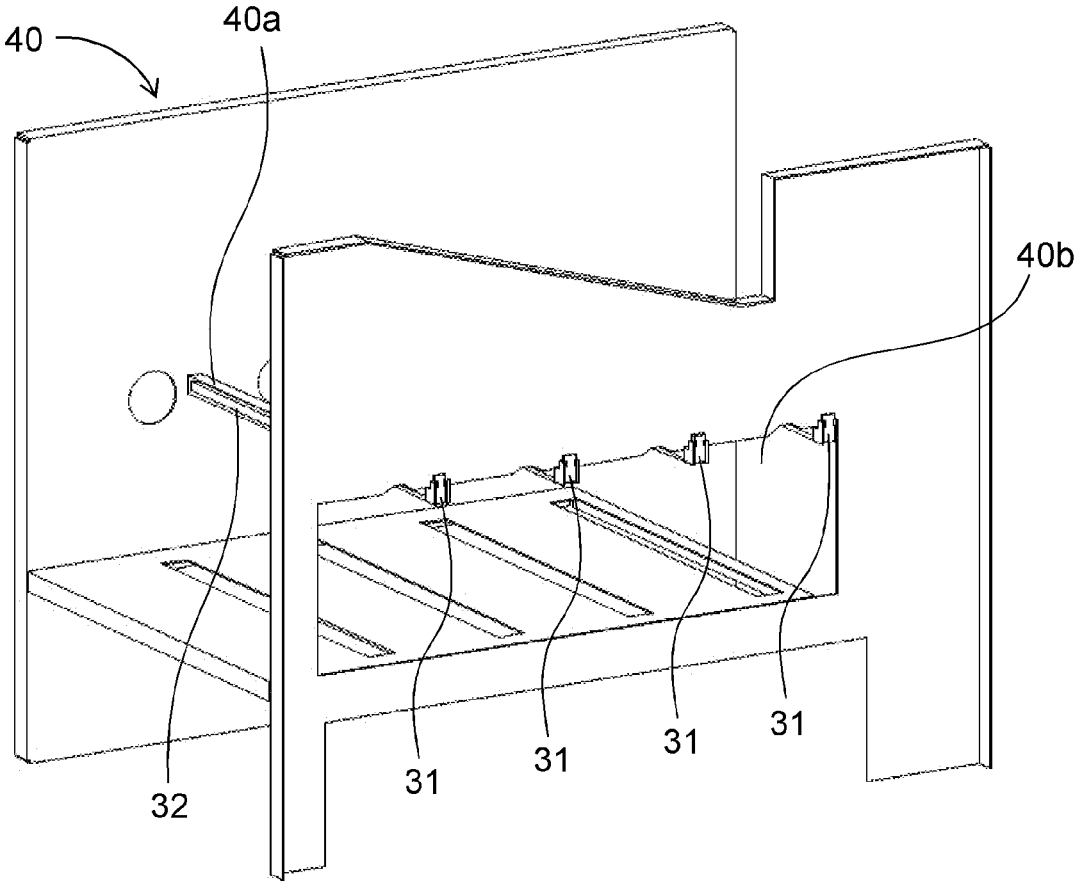
FIG. 7 is a perspective view illustrating an arrangement relationship between a housing and an LED substrate according to the first embodiment.

FIG. 7 is a perspective view illustrating a disposition relationship of the housing 40 and the discharging exposure unit 30. Since the protection portion 32*b* of the light guide 32 is mounted on the stay 40*a* constituting a part of the housing 40, the discharging exposure unit 30 is supported by the housing 40, and the LED 31*a* and the positioning member 33 are disposed by being exposed to the surface of the housing 40. As described above, since the region on which the discharging exposure unit 30 can be disposed is small and limited, the light guide 32 has a shape elongated in the axis direction of the photosensitive drum 1 and is easily deformed by warping or the like. Therefore, by supporting the light guide 32 by the firmer stay 40*a*, predetermined position and attitude are held with respect to the photosensitive drum 1 and the intermediate transfer belt 12*e*.

When the light guide 32 is mounted on the stay 40*a*, the second light guide path 32*d* has a recessed shape extending along the rotation axis of the photosensitive drum 1, the reflection surface 30*a* is provided in the recessed shape, and an outer surface side of the reflection surface 30*a* is disposed so as to oppose the stay 40*a*. Moreover, in a state where the protection portion 32*b* is mounted on the stay 40*a*, the protection portion 32*b* is located so as to cover the reflection surface 30*a* and a part above the opposing surface of the stay 40*a*. That is, in a state where the stay 40*a* supports the light guide 32, it is configured such that the reflection surface 32*a* is located on a lower side in a vertical direction of the protection portion 32*b*. Therefore, the reflection surface 32*a* is faced with the stay 40*a*, and the part above is covered by the protection portion 32*b* and thus, a foreign substance or the like can hardly enter a portion of the reflection surface 32*a* from outside, and the configuration prevents nonconformity such as deterioration of a reflection rate and the like.

Moreover, the stay 40*a* is included in the housing 40 in parallel with the rotation axis of the photosensitive drum 1 and has a function as a guide member which guides the process cartridge 7 when it is attached/detached to/from the image forming apparatus 100 main body. Since the stay 40*a* supporting the light guide 32 regulates the position and attitude when the process cartridge 7 is attached/detached, it is configured such that an attaching/detaching work of the process cartridge 7 can be performed in a state where a predetermined clearance is maintained with respect to the light guide 32. That is, since the stay 40*a* regulates the process cartridge 7, interference of the process cartridge 7 with the discharging exposure unit 30 or breakage of the light guide 32 or damage thereon is prevented.

As shown in FIG. 7, the housing 40 has an opening portion 40*b* through which the photosensitive drum 1 can be inserted/removed on a front surface side of the image forming apparatus 100. When a user attaches/detaches the process cartridge 7 attached to the image forming apparatus 100, the user operates insertion/removal in the axis direction of the photosensitive drum 1 through the opening portion 40*b*. The LED substrate 31 is disposed on the outer side of the housing 40 and on a side where the opening portion 40*b* is provided and is disposed on the outer side of a region for attachment/detachment so that interference does not occur at the attachment/detachment of the process cartridge 7. When an electric charge such as static electricity is applied to a conductor portion such as a circuit portion of the LED substrate 31, the LED 31*a* is broken and does not function as the discharging exposure unit anymore and thus, the LED substrate 31 and the positioning member 33 are covered by the protective cover 41 so that the user does not touch it (see FIG. 2). In this embodiment, the protective cover 41 is constituted capable of being removed from the housing 40 and is formed of a resin which is an insulating body against the static electricity.

Subsequently, an operation of the discharging exposure unit 30 during the image forming process will be described by using FIGS. 3 and 4. As described above, the toner image formed on the photosensitive drum 1 surface of the process cartridge 7 by the image forming process is transferred to the surface of the intermediate transfer belt 12*e* which is the toner-image bearing member by the primary transfer rollers 12*a* to 12*d* (see FIG. 3). When the image forming process is started to irradiate the photosensitive drum 1 surface having gone through the primary transfer process with discharging light from the discharging exposure unit 30, the LED 31*a* of the discharging exposure unit 30 emits light. While the image forming process is being performed, the LED 31*a* is lighted, and the emitted light enters the light guide 32. The light incident to the light guide 32 repeats reflection in the light guide 32 and is transmitted to the axis direction of the photosensitive drum 1 and is reflected by the reflection surface 32*a* to the photosensitive drum 1 side. The light guide 32 emits a predetermined light amount to the photosensitive drum 1 having gone through the primary transfer process and discharges the remaining potential on the photosensitive drum 1 (see FIG. 4).

(3) Configuration of Opening/Closing Cover

On a front of the image forming apparatus in this embodiment, the opening/closing cover 42 which can transit from a closed state to an open state is disposed, and FIG. 2 illustrates an example of the opening/closing cover 42 in this embodiment. The opening/closing cover 42 is capable of being opened/closed around a rotation axis 42*a*. In this embodiment, when the user opens the opening/closing cover 42 so as to bring about the open state, the user can make an access to the process cartridge 7 for performing a replacement work of the process cartridge 7 and the like. And at a time other than the replacement work, by bringing the opening/closing cover 42 into the closed state, the process cartridge 7 can be covered and protected. Here, as shown in FIG. 4, the LED substrate 31 of the discharging exposure unit 30 is provided on the side where the process cartridge 7 is attached/detached (on the front surface side of the image forming apparatus 100), but since it is disposed on the outer side of the region for attachment/detachment, it does not obstruct the attaching/detaching work of the process cartridge 7.

(4) Replacement Work of LED Substrate

The replacement work of the LED substrate 31 will be described by using FIGS. 2, 5 and 7. A worker who performs the replacement work such as a serviceman opens the opening/closing cover 42 and removes the protective cover 41 (see FIG. 2). When the protective cover 41 is removed, such a state is brought about that the LED substrate 31 and the positioning member 33 can be touched (see FIG. 5). The LED substrate 31 which needs to be replaced is removed from the positioning member 33 and is pulled out from an electric connecting portion such as a connector (not shown), whereby the LED substrate 31 can be removed from the image forming apparatus 100 (see FIG. 7). That is, in this embodiment, since the LED substrate 31 and the positioning member 33 are disposed on the outer side of the housing 40, visibility is good, and a sufficient work space is ensured. Moreover, attachment/detachment of the process cartridge 7 is not required, and only the LED substrate 31 can be removed from the positioning member 33 and thus, the entire system of the discharging exposure unit 30 does not have to be removed from the image forming apparatus 100, and the replacement work can be performed easily. Therefore, with the configuration of the discharging exposure unit 30 in this embodiment, an easy replacement work of the LED substrate 31 which needs replacement is enabled, and the image forming apparatus resulting in improvement of maintenance performances can be provided. Note that, in this embodiment, the light guide 32 is configured to include the light guide path, but even in a configuration in which the light guide member does not include the similar light guide path, the similar effect of improvement in the maintenance performance can be acquired by the configuration having the installation position of the LED substrate 31 and the positioning member 33.

Second Embodiment

Subsequently, a second embodiment according to the present invention will be described by using FIGS. 3, 8, 9 and 10. Note that, in the second embodiment, configurations different from those of the first embodiment will be described in detail. Unless particularly described separately, the materials, the shapes and the like are similar to those in the first embodiment. Such portions are given the same numbers, and detailed description will be omitted.

Figure 8:
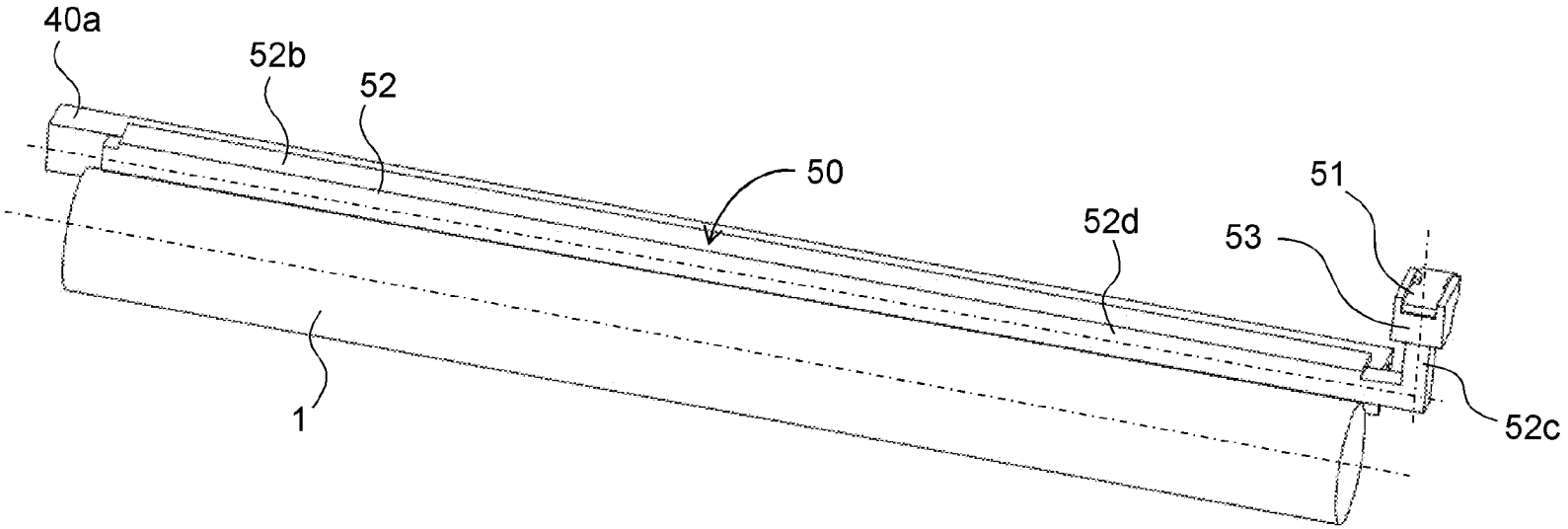
FIG. 8 is a perspective view illustrating the discharging exposure unit according to a second embodiment.
Figure 9:
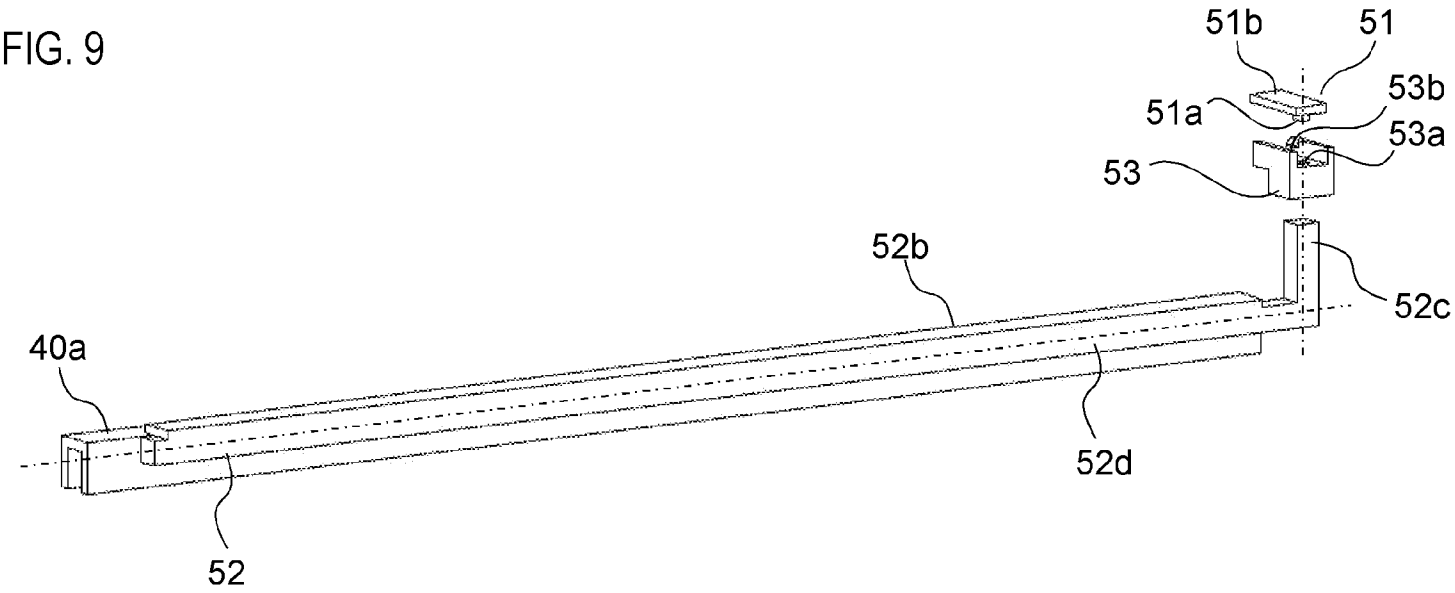
FIG. 9 is a perspective view illustrating a component configuration of the discharging exposure unit according to the second embodiment.
Figure 10:
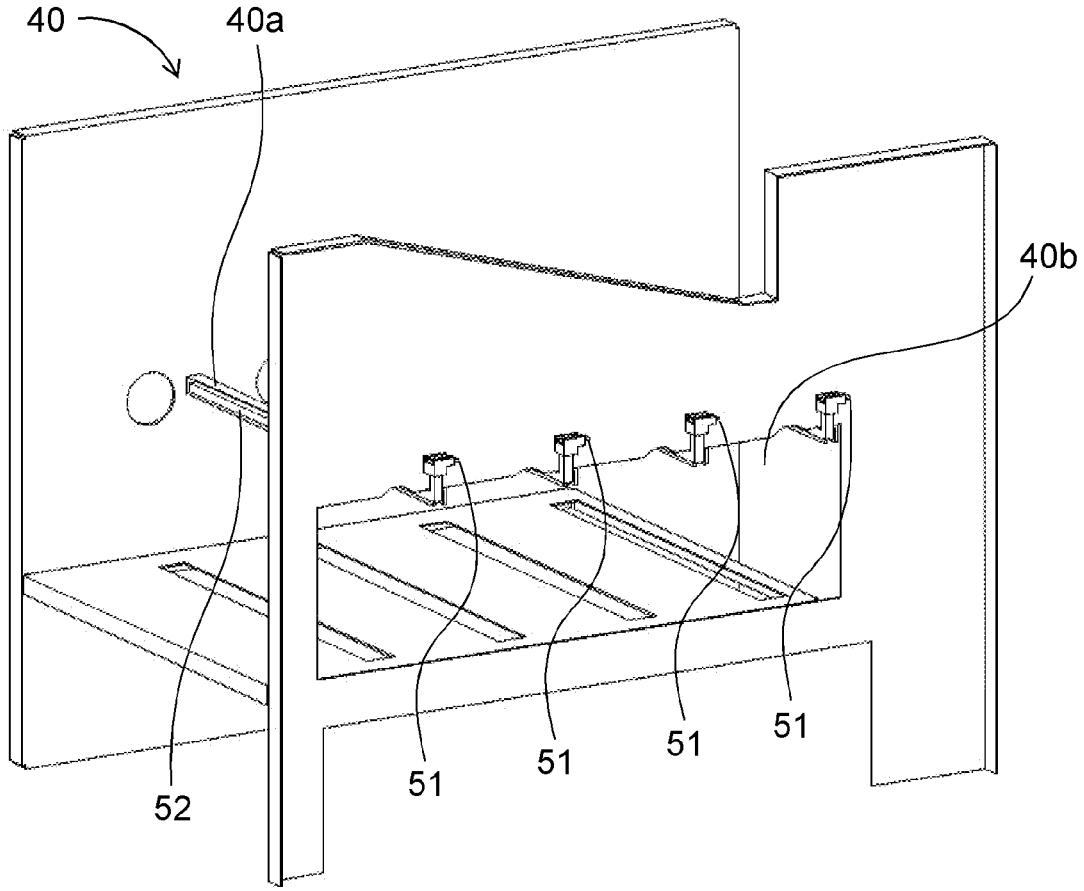
FIG. 10 is a perspective view illustrating an arrangement relationship between a housing and an LED substrate according to the second embodiment.

Hereinafter, the second embodiment of the present invention will be described on the basis of the figures. FIG. 3 is a cross sectional view illustrating an outline configuration of the discharging exposure unit in the embodiment of the present invention, and FIGS. 8 and 9 are perspective views illustrating major parts of discharging exposure unit 50. Moreover, FIG. 10 is a perspective view illustrating disposition of the housing and the LED substrate of the image forming apparatus according to the embodiment of the present invention.

FIG. 3 is a cross sectional view illustrating an outline configuration of the discharging exposure unit in the embodiment of the present invention, FIG. 8 is a perspective view illustrating an outline configuration of the discharging exposure unit 50, and FIG. 9 is a perspective view illustrating a state where constituent components of the discharging exposure unit 50 are separated. The discharging exposure unit 50 is constituted mainly by an LED substrate 51, a light guide 52, and a positioning member 53. In the LED substrate 51, an LED 51*a* as a light source which emits light is mounted on a substrate portion 51*b*. The light guide 52 is constituted by a reflection surface 52*a*, a protection portion 52*b*, a first light guide path 52*c* and a second light guide path 52*d*. The positioning member 53 includes a through hole 53*a* which guides the light from the LED 51*a* to the light guide 52 and a substrate holding portion 53*b* engaged with the substrate portion 51*b*.

An end portion of the first light guide path 52*c* is faced with the LED 51*a* via the through hole 53*a* of the positioning member 53 and guides the light incident from the LED 51*a* to the second light guide path 52*d*. The second light guide path 52*d* extends in the axis direction of the photosensitive drum 1 and guides the light in the axis direction. In this embodiment, a distal end of the first light guide path 52*c* extends in a direction intersecting and orthogonal to the axis direction of the second light guide path 52*d*. That is, it is such a configuration that the optical axis of the LED 51*a* and the rotation axis of the photosensitive drum 1 are orthogonal to each other. Moreover, on a surface of the second light guide path 52*d* on a side opposite to the photosensitive drum 1, the reflection surface 52*a* is provided. The light guided in the second light guide path 52*d* is reflected by the reflection surface 52*a* toward the photosensitive drum 1 side, and the light is emitted to the photosensitive drum 1 from the second light guide path 52*d*. Above the reflection surface 52*a*, the protection portion 52*b* mounted on the housing 40 and covering the reflection surface is provided (see FIG. 3).

As shown in FIGS. 8 and 9, the LED 51*a* and the light guide 52 are linked via the positioning member 53, and the positioning member 53 is constituted so as to removably hold the LED substrate 51. Since the LED 51*a* and the light guide 52 linked by the positioning member 53 are held in a positioned state, they are disposed such that the light emitted from the LED 51*a* is incident to the first light guide path 52*c* of the light guide 52 without a loss.

As shown in FIG. 10, in this embodiment, when the discharging exposure unit 50 is mounted on the housing 40, the first light guide path 52*c* is disposed so as to be directed upward in the vertical direction, and the LED substrate 51 is disposed on the outer side of the housing 40. By having the configuration as above, since the LED substrate 51 can be pushed in from above, force can be applied easily, workability is good, and such a state can be prevented easily that the LED substrate 51 slips down during the replacement work and the LED 51*a* is broken.

With the configuration described above, since the LED substrate 51 and the positioning member 53 are disposed on the outer side of the housing 40 in this embodiment, too, visibility is good, and a sufficient work space is ensured. Moreover, attachment/detachment of the process cartridge 7 is not required, and only the LED substrate 51 can be removed from the positioning member 53 and thus, the entire system of the discharging exposure unit 50 does not have to be removed from the image forming apparatus 100, and the replacement work can be performed easily. Therefore, with the configuration of the discharging exposure unit 50 in this embodiment, an easy replacement work of the LED substrate 51 which needs replacement is enabled, and the image forming apparatus resulting in improvement of maintenance performances can be provided.

VARIATIONS

The preferred embodiments of the present invention have been described above, but the present invention is not limited to these embodiments but is capable of various variations and changes within a range of the gist thereof. One example of the variations will be shown below.

Variation 1

In the aforementioned embodiment, the light guide guides the light from the outer side of the housing to the inner side thereof through the opening portion for attachment/detachment of the process cartridge, but a similar working effect can be acquired even in a case where another opening portion is passed through. For example, an opening portion for the light guide and an opening portion for the process cartridge 7 may be provided separately.

Variation 2

In the aforementioned embodiment, the present invention is applied to the process-cartridge type image forming apparatus, but the similar working effect can be acquired even with a configuration where the developing unit or the image bearing member is not detachably attached to the image forming apparatus main body as long as the opening portion through which the light guide 32 passes is provided on the housing.

Variation 3

In the aforementioned embodiment, the through hole of the positioning member is constituted by the two square holes, and positioning is performed by contact of the light guide with the end portion of the hole, but the similar working effect can be acquired when the through hole is constituted by a single hole. For example, movement of the through hole in the axis direction may be regulated by providing a step on the end portion side of the light guide, and by contact of the end portion of the positioning member with the step.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-059415, filed on Mar. 31, 2021, which is hereby incorporated by reference herein in its entirety.

What is claimed is:

1. An image processing apparatus comprising:

a housing;

a cartridge, including a rotatable image bearing member, attachable to and detachable from the housing along an axis direction of the rotatable image bearing member;

an opening/closing member that is openable and closable to cover an opening portion provided on a surface of the housing, through which the cartridge is insertable and removable;

a discharging exposure unit including:

a light source member located outside the surface of the housing opened and closed by the opening/closing member; and a light guide member that provides a light guide path for guiding light from the light source member to the rotatable image bearing member to expose the rotatable image bearing member, wherein the light source member is attachable to and detachable from the light guide member.

2. The image processing apparatus according to claim 1, wherein the discharging exposure unit further includes a positioning member interposed between the light source member and the light guide member and linking the light source member and the light guide member, in a state where the light source member is attached to the light guide member.

3. The image processing apparatus according to claim 2, wherein, in the state where the light source member is attached to the light guide member, the positioning member links the light source member and the light guide member so that an optical axis of a light source of the light source member extends parallel to a rotation axis of the rotatable image bearing member.

4. The image processing apparatus according to claim 2, wherein, in the state where the light source member is attached to the light guide member, the positioning member links the light source member and the light guide member so that an optical axis of a light source of the light source member extends in a direction intersecting a rotation axis of the rotatable image bearing member.

5. The image processing apparatus according to claim 2, wherein:

the rotatable image bearing member is rotatable about a rotation axis inside the housing; and the light guide path includes, in the state where the light source member is attached to the light guide member:

a first light guide path into which light emitted by the light source member is emitted; and a second light guide path that extends from the first light guide path spaced along a surface of the image bearing member, parallel to the rotation axis of the image bearing member, and causes the light to be emitted to an entire region in a longitudinal direction along the rotation axis.

6. The image processing apparatus according to claim 5, wherein, in the state where the light source member is attached to the light guide member, the positioning member links the light source member and the light guide member so that an optical axis of a light source of the light source member extends parallel with the rotation axis.

7. The image processing apparatus according to claim 6, wherein, in the state where the light source member is attached to the light guide member, the positioning member links the light source member and the light guide member so that the first light guide path and the light source member are aligned along a direction in which the second light guide path extends.

8. The image processing apparatus according to claim 5, wherein, in the state where the light source member is attached to the light guide member, the positioning member links the light source member and the light guide member so that an optical axis of a light source of the light source member extends in a direction intersecting the rotation axis.

9. The image processing apparatus according to claim 8, wherein, in the state where the light source member is attached to the light guide member, the first light guide path includes a portion extending in a direction intersecting a direction in which the second light guide path extends.

10. The image processing apparatus according to claim 9, wherein the first light guide path includes a portion extending upward in a vertical direction.

11. The image processing apparatus according to claim 1, wherein:

the housing includes a stay that guides the cartridges while the cartridge is being attached to or detached from the housing; and the light guide member is mounted on the stay.

12. The image processing apparatus according to claim 11, wherein:

the light guide member includes:

a reflection surface that reflects light toward the rotatable image bearing member; and a protection portion, the reflection surface is disposed opposing the stay, and the protection portion covers the reflection surface and part above a surface of the stay opposing the reflection surface.

13. The image processing apparatus according to claim 11, wherein, in a state where the light source member is attached to the light guide member, the light source member is disposed in a vicinity of the opening portion.

14. The image processing apparatus according to claim 11, further comprising a protective cover attachable to and detachable from the housing, and covering the light source member, in a state where the protective cover is attached to the housing and the light source member is attached to the light guide member.

* * * * *